US009147999B2

(12) United States Patent
Bolz

(10) Patent No.: US 9,147,999 B2
(45) Date of Patent: Sep. 29, 2015

(54) IGNITION APPARATUS

(71) Applicant: CONTINENTAL AUTOMOTIVE GMBH, Hannover (DE)

(72) Inventor: Stephan Bolz, Pfatter (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 14/188,906

(22) Filed: Feb. 25, 2014

(65) Prior Publication Data

US 2014/0239838 A1 Aug. 28, 2014

(30) Foreign Application Priority Data

Feb. 25, 2013 (DE) ..... 10 2013 203 002

(51) Int. Cl.

| | |
|---|---|
| ***F02P 3/08*** | (2006.01) |
| ***H01T 15/00*** | (2006.01) |
| ***F02P 3/04*** | (2006.01) |
| *H01F 38/12* | (2006.01) |

(52) U.S. Cl.

CPC . *H01T 15/00* (2013.01); *F02P 3/04* (2013.01); *H01F 38/12* (2013.01)

(58) Field of Classification Search

USPC ..... 315/219, 223, 224, 209 T, 209 CD, 315/209 M; 123/596, 597, 594, 621

See application file for complete search history.

(56) References Cited

U.S. PATENT DOCUMENTS

| | | | | |
|---|---|---|---|---|
| 3,782,353 | A * | 1/1974 | Kammerer et al. | 123/596 |
| 3,882,341 | A | 5/1975 | Green | |
| 5,603,307 | A | 2/1997 | Morita et al. | |
| 2009/0194082 | A1 | 8/2009 | Yamamura et al. | |

FOREIGN PATENT DOCUMENTS

| | | | |
|---|---|---|---|
| DE | 9002372 | U1 | 7/1991 |
| DE | 19603113 | C2 | 7/1998 |
| JP | 57171075 | S | 10/1982 |

* cited by examiner

*Primary Examiner* — David H Vu

(74) *Attorney, Agent, or Firm* — Laurence A. Greenberg; Werner H. Sterner; Ralph E. Locher

(57) ABSTRACT

An ignition apparatus has an ignition transformer that has a primary winding and a secondary winding. The transformer has a first primary winding connection for connection to a first supply voltage potential and a second primary winding connection for connection to a second supply voltage potential via a controllable switching element. Accordingly a first capacitor is connected up between the first primary winding connection and the second supply voltage potential and a second capacitor is connected up between the second primary winding connection and the second supply voltage potential.

7 Claims, 1 Drawing Sheet

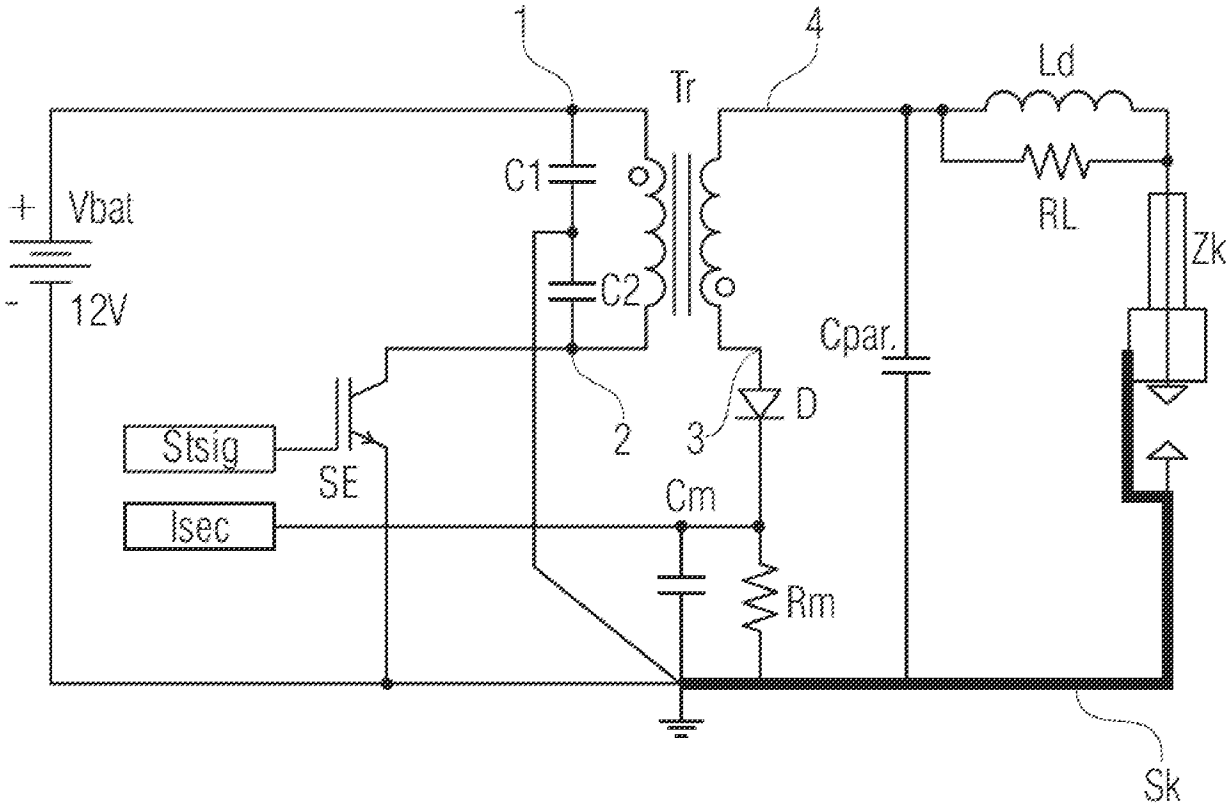
Zk
Ld
RL
Sk
Cpar.
4
Tr
D
3
Rm
Cm
C1
C2
2
1
SE
Stsig
Isec
Vbat
12V
+
-

IGNITION APPARATUS

CROSS-REFERENCE TO RELATED APPLICATION

This application claims the priority, under 35 U.S.C. §119, of German application DE 10 2013 203 002.9, filed Feb. 25, 2013; the prior application is herewith incorporated by reference in its entirety.

BACKGROUND OF THE INVENTION

Field of the Invention

The invention relates to an ignition apparatus having an ignition transformer that has a primary winding and a secondary winding. The transformer has a first primary winding connection for connection to a first supply voltage potential and a second primary winding connection for connection to a second supply voltage potential via a controllable switch element.

Such an ignition apparatus is known from German patent DE 196 03 113 C2, corresponding to U.S. Pat. No. 5,603,307. This document proposes, instead of the usual damping resistor incorporated in the spark plug for damping high discharge current spikes during the ignition process on account of the discharge of parasitic capacitances on the secondary side of the ignition transformer or between the windings of the ignition transformer, providing a buffer coil as an interference-suppression element close to the secondary winding.

U.S. Pat. No. 3,882,341 discloses the practice of arranging a damping coil directly in the spark-plug body.

The low-impedance damping coils means that firstly good damping of the current spikes brought about by the parasitic capacitances is achieved but secondly high power loss in a damping resistor at the higher ignition energies that are required for highly charged gasoline engines is also avoided.

In order to achieve good magnetic coupling, the windings of the ignition coil are usually arranged coaxially above one another. The resultant capacitance between the windings prompts the voltage edge to be coupled from the secondary winding into the primary winding when the secondary voltage breaks down. In this case, the turns ratio is immaterial, however; only the magnitude of the coupling capacitance counts.

The enormous voltage change of approximately 20 kV in a few nanoseconds means that even a coupling capacitance of a few picofarads has a great influence. Added to this is the fact that the supply lines to the ignition coil are usually 0.5 m to 1 m long and therefore form an efficient antenna for electromagnetic radiation of the interference signal.

A further problem is a current measuring resistor that is frequently arranged in the secondary circuit and on which the current spike results in a corresponding voltage spike.

SUMMARY OF THE INVENTION

It is therefore the object of the invention to reduce the influence of current or voltage spikes.

With the foregoing and other objects in view there is provided, in accordance with the invention, According to the invention, an ignition apparatus of the type in question has a first capacitor connected between the first primary winding connection and the second supply voltage potential and a second capacitor connected between the second primary winding connection and the second supply voltage potential. This measure brings about effective damping of the interference signals that are coupled in from the secondary side to the primary side of the ignition transformer.

In one development of the invention, a parallel circuit containing a measuring resistor and an interference-suppression capacitor is connected up between a first secondary winding connection and the second supply voltage potential. The interference-suppression capacitor connected in parallel with the measuring resistor can effectively damp high voltage spikes that occur on the measuring resistor.

In a further advantageous development of the apparatus according to the invention, a second secondary winding connection is connected to a spark plug that is embodied with a shielding cup that connects the ground connection of the spark plug to the second supply voltage potential and that at least partly surrounds the spark plug, wherein the parallel circuit containing the measuring resistor and the interference-suppression capacitor is in the form of a connecting element between the shielding cup and the first secondary winding connection. This short, well-shielded connection between the ground electrode of the spark plug, the second supply voltage potential and the first secondary winding connection can effectively prevent undesirable electromagnetic interference radiation.

Other features which are considered as characteristic for the invention are set forth in the appended claims.

Although the invention is illustrated and described herein as embodied in an ignition apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing is a schematic diagram of an ignition apparatus according to the invention.

DETAILED DESCRIPTION OF THE INVENTION

Referring now to the single FIGURE of the drawing in detail, there is shown a circuit implementation of an ignition apparatus having an ignition transformer Tr, a primary winding of which has a first primary winding connection 1 and a second primary winding connection 2. The first primary winding connection 1 is connected to the first supply voltage potential Vbat+ and the second primary winding connection 2 is connected via a controllable switching element SE, which is in the form of an insulated gate bipolar transistor (IGBT) in the exemplary embodiment shown, to the second supply voltage potential Vbat−. In the example shown, the supply voltage has a value of 12 V and is delivered directly by the vehicle battery in this case. It may also have other values. The switching element SE is actuated in a known manner by a flow controller—not shown—using a control signal Stsig in order, after a switched-on time, during which the ignition transformer Tr is charged, to interrupt the flow of current through the primary winding, which produces a high voltage on the secondary side of the ignition transformer Tr that results in a breakdown on the electrodes of the spark plug Zk connected on the secondary side of the ignition transformer Tr. A secondary-side parasitic capacitance Cpar means that in the unprotected state of such an ignition apparatus a high current spike arises during the breakdown on the electrodes of the spark plug Zk. For this reason, a damping inductance Ld is incorporated with a winding resistor RL in the connection between the second secondary winding connection 4 and a center electrode of the spark plug Zk, this damping inductance Ld advantageously being wound on a magnetic material having high internal damping as a winding in the spark-plug body. In order to shield the supply line to the spark plug ZK, a shielding cup Sk—which is shown only Schematically—is shown, as is known from German patent DE 90 02 372, for example.

The first secondary winding connection 3 of the ignition transformer Tr is connected to the second supply voltage potential Vbat− via a diode D and a current measuring resistor Rm. In order to damp the voltage spikes arising on the measuring resistor Rm on account of the current spikes that arise during the ignition process, an interference-suppression capacitor Cm is connected in parallel with the current measuring resistor Rm in a manner according to the invention.

In one advantageous form of the invention, the current measuring resistor Rm and the interference-suppression capacitor Cm are physically arranged between the shielding cup Sk and the first secondary winding connection 3, which can be effected particularly advantageously when the ignition apparatus is plugged directly onto the spark plug Zk, which is the case with top plug coils or pencil coils, for example.

In order to damp the interference signals that arise on the secondary side of the ignition apparatus and that are capacitively coupled onto the primary side via the turns of the primary winding and the secondary winding that are wound onto one another, the first primary winding connection 1 is connected to the second supply voltage potential Vbat−, which is usually the ground connection, via a first capacitor C1 and the second primary winding connection 2 is connected to the second supply voltage potential Vbat− via a second capacitor, in a manner according to the invention. Since the capacitance of the coupling between the primary and secondary windings of the ignition transformer Tr exists along the entire surface area, the interference signal coupled in on the primary side also has a common-mode component that can be effectively damped by the interference-suppression capacitors C1, C2 according to the invention.

As an alternative to the capacitors C1, C2, shielding between the windings would also be possible; this involves a conductive foil being placed between the windings that has no circulating current path in the direction of winding, however. This shielding winding is connected to the ground potential or to the second supply voltage potential Vbat− and discharges the capacitive charging currents, so that the primary winding is no longer subjected to interference. However, this is a relatively expensive measure and also the undesirable secondary parasitic capacitance is increased.

The invention claimed is:

1. An ignition apparatus, comprising:

a controllable switching element;

an ignition transformer having a primary winding, a secondary winding, a first primary winding connection for connecting to a first supply voltage potential, and a second primary winding connection disposed at an end of said primary winding for connecting to a second supply voltage potential via said controllable switching element;

a first capacitor connected between said first primary winding connection and the second supply voltage potential; and a second capacitor connected directly between said second primary winding connection and the second supply voltage potential, said first capacitor and said second capacitor being connected serially to each other and parallel to said primary winding for damping interference signals arising on a secondary side of the ignition apparatus.

2. An ignition apparatus, comprising:

a controllable switching element;

an ignition transformer having a primary winding, a secondary winding, a first primary winding connection for connecting to a first supply voltage potential, a second primary winding connection for connecting to a second supply voltage potential via said controllable switching element, and a first secondary winding connection;

a first capacitor connected between said first primary winding connection and the second supply voltage potential;

a second capacitor connected between said second primary winding connection and the second supply voltage potential; and a measuring parallel circuit having a measuring resistor and an interference-suppression capacitor, said measuring parallel circuit is connected up between said first secondary winding connection and the second supply voltage potential.

3. The ignition apparatus according to claim 2, further comprising a damping inductance;

further comprising a spark plug having a center electrode; and wherein said ignition transformer has a second secondary winding connection connected directly to said center electrode of said spark plug via said damping inductance.

4. The ignition apparatus according to claim 3, wherein said spark plug has a spark-plug body and said damping inductance is disposed in said spark-plug body as a coil.

5. The ignition apparatus according to claim 4, wherein said spark plug has a core of magnetic material having high internal damping and said coil is wound on said core of magnetic material having high internal damping.

6. The ignition apparatus according to claim 3, wherein said spark plug has a ground connection; and further comprising a shielding cup, said spark plug is at least partly surrounded by said shielding cup that connects said ground connection of said spark plug to the second supply voltage potential.

7. The ignition apparatus according to claim 6, wherein said measuring parallel circuit is a connecting element disposed between said shielding cup and said first secondary winding connection.

* * * * *